US008383310B2

(12) United States Patent
Mang et al.

(10) Patent No.: US 8,383,310 B2
(45) Date of Patent: Feb. 26, 2013

(54) TONER COMPOSITIONS

(75) Inventors: Mark E. Mang, Rochester, NY (US); Timothy L. Lincoln, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 305 days.

(21) Appl. No.: 12/768,000

(22) Filed: Apr. 27, 2010

(65) Prior Publication Data

US 2011/0262855 A1 Oct. 27, 2011

(51) Int. Cl.
*G03G 9/08* (2006.01)

(52) U.S. Cl. ..... 430/109.1; 430/109.4

(58) Field of Classification Search ..... 430/109.1, 430/109.4
See application file for complete search history.

(56) References Cited

U.S. PATENT DOCUMENTS

| | | | |
|---|---|---|---|
| 3,590,000 | A | 6/1971 | Palermiti et al. |
| 3,800,588 | A | 4/1974 | Larson et al. |
| 3,847,604 | A | 11/1974 | Hagenbach et al. |
| 3,944,493 | A | 3/1976 | Jadwin et al. |
| 4,007,293 | A | 2/1977 | Mincer et al. |
| 4,079,014 | A | 3/1978 | Burness et al. |
| 4,295,990 | A | 10/1981 | Verbeek et al. |
| 4,394,430 | A | 7/1983 | Jadwin et al. |
| 4,560,635 | A | 12/1985 | Hoffend et al. |
| 4,797,339 | A | 1/1989 | Maruyama et al. |
| 4,935,326 | A | 6/1990 | Creatura et al. |
| 4,937,166 | A | 6/1990 | Creatura et al. |
| 4,983,488 | A | 1/1991 | Tan et al. |
| 4,996,127 | A | 2/1991 | Hasegawa et al. |
| 5,236,629 | A | 8/1993 | Mahabadi et al. |
| 5,290,654 | A | 3/1994 | Sacripante et al. |
| 5,302,486 | A | 4/1994 | Patel et al. |
| 5,330,874 | A | 7/1994 | Mahabadi et al. |
| 5,364,729 | A | 11/1994 | Kmiecik-Lawrynowicz et al. |
| 5,403,693 | A | 4/1995 | Patel et al. |
| 6,063,827 | A | 5/2000 | Sacripante et al. |
| 6,214,507 | B1 | 4/2001 | Sokol et al. |
| 6,359,105 | B1 | 3/2002 | Ianni et al. |
| 6,593,049 | B1 | 7/2003 | Veregin et al. |
| 6,756,176 | B2 | 6/2004 | Stegamat et al. |
| 6,830,860 | B2 | 12/2004 | Sacripante et al. |
| 7,442,730 | B2 | 10/2008 | Ito |
| 7,452,646 | B2 | 11/2008 | Hu et al. |
| 2008/0131800 | A1 * | 6/2008 | Marsh et al. ..... 430/59.6 |
| 2009/0081577 | A1 | 3/2009 | Mang et al. |

* cited by examiner

*Primary Examiner* — Mark A Chapman
(74) *Attorney, Agent, or Firm* — MDIP LLC

(57) ABSTRACT

The present disclosure relates to a binder resin system suitable for use in forming toner compositions. In embodiments, the binder resin system includes at least one amorphous resin, at least one crystalline resin, and at least one fatty acid salt. The presence of the fatty acid salt reduces plasticization which may otherwise occur upon combining the amorphous and crystalline resins, thereby increasing the glass transition temperature of the binder resin, as well as any toner produced with such binder resin. Toners produced with the disclosed binder resin may also include one or more optional ingredients such as optional colorants, optional waxes, and combinations thereof.

13 Claims, No Drawings

TONER COMPOSITIONS

BACKGROUND

The present disclosure relates to toners suitable for electrophotographic apparatuses.

Numerous processes are known for the preparation of toners, such as, for example, conventional processes wherein a resin is melt kneaded or extruded with a pigment, micronized and pulverized to provide toner particles. There are illustrated in U.S. Pat. Nos. 5,364,729 and 5,403,693, the disclosures of each of which are hereby incorporated by reference in their entirety, methods of preparing toner particles by blending together latexes with pigment particles. Also relevant are U.S. Pat. Nos. 4,996,127, 4,797,339 and 4,983,488, the disclosures of each of which are hereby incorporated by reference in their entirety.

Toner systems normally fall into two classes: two component systems, in which the developer material includes magnetic carrier granules having toner particles adhering triboelectrically thereto; and single component systems (SCD), which typically use only toner. Placing charge on the particles, to enable movement and development of images via electric fields, is most often accomplished with triboelectricity. Triboelectric charging may occur either by mixing the toner with larger carrier beads in a two component development system or by rubbing the toner between a blade and donor roll in a single component system. Toners should also display acceptable triboelectric properties, which may vary with the type of carrier or developer composition.

Polyester toners have been prepared utilizing amorphous and crystalline polyester resins. An issue which may arise with this formulation is that plasticization may occur upon combining the amorphous and crystalline resins, which may result in a decrease in the glass transition temperature of the toner. The resulting toner may thus have a glass transition temperature equal to or less than the temperature found in an electrophotographic machine/apparatus, which may give rise to image defects.

Improved toners, and methods for forming such toners, thus remain desirable.

SUMMARY

The present disclosure provides toners and processes for producing same. In embodiments, a toner composition of the present disclosure may include a binder resin including at least one amorphous resin, at least one crystalline resin, and a fatty acid salt; and one or more optional ingredients such as colorants, waxes, and combinations thereof.

In other embodiments, a toner of the present disclosure may include a binder resin including at least one amorphous resin such as polyester resins, partially crosslinked polyester resins, and combinations thereof, at least one crystalline resin having about 8 carbon atoms or less, and a fatty acid salt; and one or more optional ingredients such as colorants, waxes, and combinations thereof.

A process of the present disclosure may include melt-mixing an amorphous resin, a crystalline resin, a fatty acid salt, an optional wax, and a colorant to form a toner; pelletizing the toner to form toner pellets; processing the toner pellets to form toner particles; and recovering the resulting toner particles.

DETAILED DESCRIPTION

The addition of a crystalline polyester to an amorphous polyester in forming a binder resin may result in a suppression of the glass transition temperature (Tg) of a toner produced with such resin. This suppression of Tg may be referred to herein, in embodiments, as plasticization. If the crystalline and amorphous resins have solubility with each other plasticization occurs. The degree of plasticization depends on the level of solubility in the resin system. Increased solubility of the resins may increase plasticization; this solubility can be reduced by using longer chain monomers for the crystalline polyester or changing the resin monomer system. However, the longer chain monomers (>8 carbon atoms) are very expensive. An alternate resin system may reduce plasticization but not meet other desired properties.

Plasticization may not be desirable because if the Tg is too low for a toner, there may be problems in storage, for example blocking, and usage of the toner at elevated temperatures. Thus, in accordance with the present disclosure, fatty acid salts may be added to the crystalline polyester and amorphous polyester to reduce the plasticization of the resin, thereby increasing the Tg of the resulting toner.

Resins

Any suitable polyester resin may be utilized in forming a toner of the present disclosure. Such resins, in turn, may be made of any suitable monomer. Any monomer employed may be selected depending upon the particular polymer to be utilized.

In embodiments, the resins may be an amorphous resin, a crystalline resin, and/or a combination thereof. In further embodiments, the polymer utilized to form the resin may be a polyester resin, including the resins described in U.S. Pat. Nos. 6,593,049 and 6,756,176, the disclosures of each of which are hereby incorporated by reference in their entirety. Suitable resins may also include a mixture of an amorphous polyester resin and a crystalline polyester resin as described in U.S. Pat. No. 6,830,860, the disclosure of which is hereby incorporated by reference in its entirety.

In embodiments, suitable amorphous resins include polyesters, polyamides, polyimides, polyolefins, polyethylene, polybutylene, polyisobutyrate, ethylene-propylene copolymers, ethylene-vinyl acetate copolymers, polypropylene, combinations thereof, and the like. Examples of amorphous resins which may be utilized include alkali sulfonated-polyester resins, branched alkali sulfonated-polyester resins, alkali sulfonated-polyimide resins, and branched alkali sulfonated-polyimide resins. Alkali sulfonated polyester resins may be useful in embodiments, such as the metal or alkali salts of copoly(ethylene-terephthalate)-copoly(ethylene-5-sulfo-isophthalate), copoly(propylene-terephthalate)-copoly(propylene-5-sulfo-isophthalate), copoly(diethylene-terephthalate)-copoly(diethylene-5-sulfo-isophthalate), copoly(propylene-diethylene-terephthalate)-copoly(propylene-diethylene-5-sulfo-isophthalate), copoly(propylene-butylene-terephthalate)-copoly(propylene-butylene-5-sulfo-isophthalate), copoly(propoxylated bisphenol-A-fumarate)-copoly(propoxylated bisphenol A-5-sulfo-isophthalate), copoly(ethoxylated bisphenol-A-fumarate)-copoly(ethoxylated bisphenol-A-5-sulfo-isophthalate), and copoly(ethoxylated bisphenol-A-maleate)-copoly(ethoxylated bisphenol-A-5-sulfo-isophthalate), wherein the alkali metal is, for example, a sodium, lithium or potassium ion.

In embodiments, an unsaturated amorphous polyester resin may be utilized as a resin. Examples of such resins include those disclosed in U.S. Pat. No. 6,063,827, the disclosure of which is hereby incorporated by reference in its entirety. Exemplary unsaturated amorphous polyester resins include, but are not limited to, poly(propoxylated bisphenol co-fumarate), poly(ethoxylated bisphenol co-fumarate), poly(butyloxylated bisphenol co-fumarate), poly(co-propoxylated bisphenol co-ethoxylated bisphenol co-fumarate), poly(1,2-propylene fumarate), poly(propoxylated bisphenol co-maleate), poly(ethoxylated bisphenol co-maleate), poly(butyloxylated bisphenol co-maleate), poly(co-propoxylated bisphenol co-ethoxylated bisphenol co-maleate), poly(1,2-propylene maleate), poly(propoxylated bisphenol co-itaconate), poly (ethoxylated bisphenol co-itaconate), poly(butyloxylated bisphenol co-itaconate), poly(co-propoxylated bisphenol co-ethoxylated bisphenol co-itaconate), poly(1,2-propylene itaconate), and combinations thereof.

Examples of diacids or diesters including vinyl diacids or vinyl diesters utilized for the preparation of amorphous polyesters include dicarboxylic acids or diesters such as terephthalic acid, phthalic acid, isophthalic acid, fumaric acid, dimethyl fumarate, dimethyl itaconate, cis, 1,4-diacetoxy-2-butene, diethyl fumarate, diethyl maleate, maleic acid, succinic acid, itaconic acid, succinic acid, succinic anhydride, dodecylsuccinic acid, dodecylsuccinic anhydride, glutaric acid, glutaric anhydride, adipic acid, pimelic acid, suberic acid, azelaic acid, dodecane diacid, dimethyl terephthalate, diethyl terephthalate, dimethylisophthalate, diethylisophthalate, dimethylphthalate, phthalic anhydride, diethylphthalate, dimethylsuccinate, dimethylfumarate, dimethylmaleate, dimethylglutarate, dimethyladipate, dimethyl dodecylsuccinate, and combinations thereof. The organic diacid or diester may be present, for example, in an amount from about 40 to about 60 mole percent of the resin, in embodiments from about 42 to about 52 mole percent of the resin, in embodiments from about 45 to about 50 mole percent of the resin.

Examples of diols which may be utilized in generating the amorphous polyester include 1,2-propanediol, 1,3-propanediol, 1,2-butanediol, 1,3-butanediol, 1,4-butanediol, pentanediol, hexanediol, 2,2-dimethylpropanediol, 2,2,3-trimethylhexanediol, heptanediol, dodecanediol, bis(hydroxyethyl)-bisphenol A, bis(2-hydroxypropyl)-bisphenol A, 1,4-cyclohexanedimethanol, 1,3-cyclohexanedimethanol, xylenedimethanol, cyclohexanediol, diethylene glycol, bis (2-hydroxyethyl)oxide, dipropylene glycol, dibutylene, and combinations thereof. The amount of organic diol selected can vary, and may be present, for example, in an amount from about 40 to about 60 mole percent of the resin, in embodiments from about 42 to about 55 mole percent of the resin, in embodiments from about 45 to about 53 mole percent of the resin.

In embodiments, a suitable polyester resin may be an amorphous polyester such as a poly(propoxylated bisphenol A co-fumarate) resin having the following formula (I):

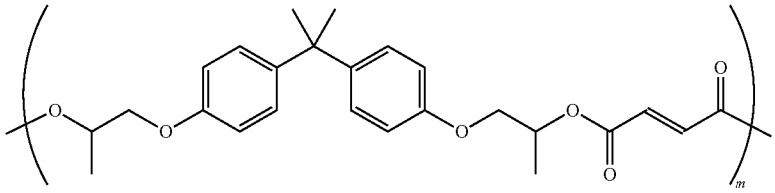

(I)

wherein m may be from about 5 to about 1000. Examples of such resins and processes for their production include those disclosed in U.S. Pat. No. 6,063,827, the disclosure of which is hereby incorporated by reference in its entirety.

In some embodiments, the amorphous resin may be crosslinked. An example is described in U.S. Pat. No. 6,359,105, the disclosure of which is hereby incorporated by reference in its entirety. For example, crosslinking may be achieved by combining an amorphous resin with a crosslinker, sometimes referred to herein, in embodiments, as an initiator. Examples of suitable crosslinkers include, but are not limited to, for example, free radical or thermal initiators such as organic peroxides and azo compounds.

As noted above, the amorphous resin may be combined with a crystalline resin. The crystalline resin may be, for example, a polyester, a polyamide, a polyimide, a polyolefin such as a polyethylene, a polypropylene, a polybutylene or an ethylene-propylene copolymer, a polyisobutyrate, an ethylene-vinyl acetate copolymer, combinations thereof, and the like. In embodiments, the crystalline resin may be sulfonated.

The crystalline resin may be prepared by a polycondensation process of reacting an organic diol and an organic diacid in the presence of a polycondensation catalyst.

Examples of organic diols include aliphatic diols with from about 2 to about 8 carbon atoms, such as 1,2-ethanediol, 1,3-propanediol, 1,4-butanediol, 1,5-pentanediol, 1,6-hexanediol, 1,7-heptanediol, 1,8-octanediol, and the like; alkali sulfo-aliphatic diols such as sodio 2-sulfo-1,2-ethanediol, lithio 2-sulfo-1,2-ethanediol, potassio 2-sulfo-1,2-ethanediol, sodio 2-sulfo-1,3-propanediol, lithio 2-sulfo-1,3-propanediol, potassio 2-sulfo-1,3-propanediol, mixtures thereof, and the like. The aliphatic diol may be present in an amount of from about 45 to about 50 mole percent of the resin, in embodiments from about 47 to about 49 mole percent of the resin, and the alkali sulfo-aliphatic diol can be present in an amount of from about 1 to about 10 mole percent of the resin, in embodiments from about 2 to about 8 mole percent of the resin.

Examples of organic diacids or diesters suitable for the preparation of the crystalline resins include oxalic acid, succinic acid, glutaric acid, adipic acid, suberic acid, azelaic acid, phthalic acid, isophthalic acid, terephthalic acid, cyclohexane dicarboxylic acid, malonic acid and mesaconic acid; diesters or anhydrides thereof; and alkali sulfo-organic diacids such as the sodium, lithium or potassium salt of dimethyl-5-sulfo-isophthalate, dialkyl-5-sulfo-isophthalate-4-sulfo-1,8-naphthalic anhydride, 4-sulfo-phthalic acid, dimethyl-4-sulfo-phthalate, dialkyl-4-sulfo-phthalate, 4-sulfophenyl-3,5-dicarbomethoxybenzene, 6-sulfo-2-naphthyl-3,5-dicarbomethoxybenzene, sulfa-terephthalic acid, dimethyl-sulfo-terephthalate, 5-sulfo-isophthalic acid, dialkyl-sulfo-terephthalate, sulfoethanediol, 2-sulfopropanediol, 2-sulfobutanediol, 3-sulfopentanediol, 2-sulfohexanediol, 3-sulfo-2-methylpentanediol, 2-sulfo-3,3-dimethylpentanediol, sulfo-p-hydroxybenzoic acid, N,N-bis(2-hydroxyethyl)-2-amino ethane sulfonate, or combinations thereof. The organic diacid may be present in an amount of, for example, from about 40 to about 50 mole percent of the resin, in embodiments from about 42 to about 48 mole percent of the resin, and the alkali sulfo-aliphatic diacid can be present in an amount of from about 1 to about 10 mole percent of the resin, in embodiments from about 2 to about 8 mole percent of the resin.

In embodiments, the crystalline polyester material may be derived from a monomer system including an alcohol such as 1,4-butanediol, 1,6-hexanediol, and combinations thereof, with a dicarboxylic acid such as fumaric acid, succinic acid, oxalic acid, adipic acid, and combinations thereof. For example, in embodiments the crystalline polyester may be derived from 1,4-butanediol, adipic acid, and fumaric acid.

In embodiments, a stoichiometric equimolar ratio of organic diol and organic diacid may be utilized. However, in some instances, wherein the boiling point of the organic diol is from about 180° C. to about 230° C., an excess amount of diol can be utilized and removed during the polycondensation process.

Suitable polycondensation catalysts for production of either the crystalline or amorphous polyesters include tetraalkyl titanates, dialkyltin oxide such as dibutyltin oxide, tetraalkyltin such as dibutyltin dilaurate, dialkyltin oxide hydroxide such as butyltin oxide hydroxide, aluminum alkoxides, alkyl zinc, dialkyl zinc, zinc oxide, stannous oxide, or combinations thereof. Catalysts may be utilized in amounts of, for example, from about 0.01 mole percent to about 5 mole percent based on the starting diacid or diester used to generate the polyester resin, in embodiments from about 0.5 to about 4 mole percent of the resin based on the starting diacid or diester used to generate the polyester resin.

The amount of catalyst utilized may vary, and can be selected in an amount, for example, of from about 0.01 to about 1 mole percent of the resin. Additionally, in place of an organic diacid, an organic diester can also be selected, with an alcohol byproduct generated during the process.

In embodiments, the crystalline resin may be a short chain length polyester, based upon monomers having a carbon chain of less than about 8 carbons, in embodiments from about 2 carbons to about 8 carbons, in embodiments from about 4 carbons to about 6 carbons. Such resins include, for example, CPES-A3C, a proprietary blend of 1,4-butanediol, fumaric acid, and adipic acid, commercially available from Kao Corporation (Japan).

The crystalline resin may be present, for example, in an amount of from about 10 to about 50 percent by weight of the binder resin components, i.e., the combination of amorphous resin, crystalline resin, and fatty acid salt, in embodiments from about 15 to about 40 percent by weight of the binder resin components.

The crystalline resin may be present, for example, in an amount of from about 5 to about 50 percent by weight of the toner components, in embodiments from about 10 to about 35 percent by weight of the toner components. The crystalline resin can possess various melting points of, for example, from about 70° C. to about 150° C., in embodiments from about 80° C. to about 140° C. The crystalline resin may have a number average molecular weight ($M_n$), as measured by gel permeation chromatography (GPC) of, for example, from about 1,000 to about 50,000, in embodiments from about 2,000 to about 25,000, and a weight average molecular weight ($M_w$) of, for example, from about 2,000 to about 100,000, in embodiments from about 3,000 to about 80,000, as determined by Gel Permeation Chromatography using polystyrene standards. The molecular weight distribution ($M_w/M_n$) of the crystalline resin may be, for example, from about 1 to about 6, in embodiments from about 2 to about 4.

One, two, or more toner resins may be used. In embodiments where two or more toner resins are used, the toner resins may be in any suitable ratio (e.g., weight ratio) such as for instance about 10% (first resin)/90% (second resin) to about 90% (first resin)/10% (second resin).

In embodiments, the resin may be formed by emulsion polymerization methods.

Fatty Acid Salt

In accordance with the present disclosure, a fatty acid salt is added to the crystalline and amorphous resins to reduce the plasticization effect of the crystalline and amorphous resins in forming the binder resin. Suitable fatty acid salts include, but are not limited to, zinc stearate, zinc laurate, zinc stearate-laurate, calcium stearate, combinations thereof, and the like. It is believed that longer and shorter carbon chain length fatty acid salts would also be suitable, such as zinc palmitate. Other fatty acid salts of other metals would also be suitable, for example, magnesium stearate.

The fatty acid salt may be added to the amorphous resin and the crystalline resin in suitable amounts. Thus, the toner may possess the fatty acid salt in an amount of from about 0.5% percent by weight to about 12% percent by weight of the toner, in embodiments from about 5% percent by weight to about 10% percent by weight of the toner.

In embodiments, the resulting binder resin system, i.e., the combination of amorphous resin, crystalline resin, and fatty acid salt, may have a glass transition temperature of from about 30° C. to about 65° C., in embodiments from about 35° C. to about 51° C.

Toner

The binder resin described above may be utilized to form toner compositions. Such toner compositions may include optional colorants, waxes, and other additives. Toners may be formed utilizing any method within the purview of those skilled in the art.

Colorants

As the colorant to be added, various known suitable colorants, such as dyes, pigments, mixtures of dyes, mixtures of pigments, mixtures of dyes and pigments, and the like, may be included in the toner.

As examples of suitable colorants, mention may be made of carbon black like REGAL 330®; magnetites, such as Mobay magnetites MO8029™, MO8060™; Columbian magnetites; MAPICO BLACKS™ and surface treated magnetites; Pfizer magnetites CB4799™, CB5300™, CB5600™, MCX6369™; Bayer magnetites, BAYFERROX 8600™, 8610™; Northern Pigments magnetites, NP604™, NP608™; Magnox magnetites TMB-100™, or TMB-104™; and the like. As colored pigments, there can be selected cyan, magenta, yellow, red, green, brown, blue or mixtures thereof. Generally, cyan, magenta, or yellow pigments or dyes, or mixtures thereof, are used. The pigment or pigments are generally used as water based pigment dispersions.

Specific examples of pigments include SUNSPERSE 6000, FLEXIVERSE and AQUATONE water based pigment dispersions from SUN Chemicals, HELIOGEN BLUE L6900™, D6840™, D7080™, D7020™, PYLAM OIL BLUE™, PYLAM OIL YELLOW™, PIGMENT BLUE 1™ available from Paul Uhlich & Company, Inc., PIGMENT VIOLET 1™, PIGMENT RED 48™, LEMON CHROME YELLOW DCC 1026™, E.D. TOLUIDINE RED™ and BON RED C™ available from Dominion Color Corporation, Ltd., Toronto, Ontario, NOVAPERM YELLOW FGL™, HOSTAPERM PINK E™ from Hoechst, and CINQUASIA MAGENTA™ available from E.I. DuPont de Nemours & Company, and the like. Generally, colorants that can be selected are black, cyan, magenta, or yellow, and mixtures thereof. Examples of magentas are 2,9-dimethyl-substituted quinacridone and anthraquinone dye identified in the Color Index as CI-60710, CI Dispersed Red 15, diazo dye identified in the Color Index as CI-26050, CI Solvent Red 19, and the like. Illustrative examples of cyans include copper tetra(octadecyl sulfonamido) phthalocyanine, x-copper phthalocyanine pigment listed in the Color Index as CI-74160, CI Pigment Blue, Pigment Blue 15:3, and Anthrathrene Blue, identified in the Color Index as CI-69810, Special Blue X-2137, and the like. Illustrative examples of yellows are diarylide yellow 3,3-dichlorobenzidene acetoacetanilides, a monoazo pigment identified in the Color Index as CI 12700, CI Solvent Yellow 16, a nitrophenyl amine sulfonamide identified in the Color Index as Foron Yellow SE/GLN, CI Dispersed Yellow 33 2,5-dimethoxy-4-sulfonanilide phenylazo-4'-chloro-2,5-dimethoxy acetoacetanilide, and Permanent Yellow FGL. Colored magnetites, such as mixtures of MAPICO BLACK™, and cyan components may also be selected as colorants. Other known colorants can be selected, such as Levanyl Black A-SF (Miles, Bayer) and Sunsperse Carbon Black LHD 9303 (Sun Chemicals), and colored dyes such as Neopen Blue (BASF), Sudan Blue OS (BASF), PV Fast Blue B2G01 (American Hoechst), Sunsperse Blue BHD 6000 (Sun Chemicals), Irgalite Blue BCA (Ciba-Geigy), Paliogen Blue 6470 (BASF), Sudan III (Matheson, Coleman, Bell), Sudan II (Matheson, Coleman, Bell), Sudan IV (Matheson, Coleman, Bell), Sudan Orange G (Aldrich), Sudan Orange 220 (BASF), Paliogen Orange 3040 (BASF), Ortho Orange OR 2673 (Paul Uhlich), Paliogen Yellow 152, 1560 (BASF), Lithol Fast Yellow 0991K (BASF), Paliotol Yellow 1840 (BASF), Neopen Yellow (BASF), Novoperm Yellow FG 1 (Hoechst), Permanent Yellow YE 0305 (Paul Uhlich), Lumogen Yellow D0790 (BASF), Sunsperse Yellow YHD 6001 (Sun Chemicals), Suco-Gelb L1250 (BASF), Suco-Yellow D1355 (BASF), Hostaperm Pink E (American Hoechst), Fanal Pink D4830 (BASF), Cinquasia Magenta (DuPont), Lithol Scarlet D3700 (BASF), Toluidine Red (Aldrich), Scarlet for Thermoplast NSD PS PA (Ugine Kuhlmann of Canada), E.D. Toluidine Red (Aldrich), Lithol Rubine Toner (Paul Uhlich), Lithol Scarlet 4440 (BASF), Bon Red C (Dominion Color Company), Royal Brilliant Red RD-8192 (Paul Uhlich), Oracet Pink RF (Ciba-Geigy), Paliogen Red 3871K (BASF), Paliogen Red 3340 (BASF), Lithol Fast Scarlet L4300 (BASF), combinations of the foregoing, and the like.

Wax

Optionally, a wax may also be combined with the resin and optional colorant in forming toner particles. When included, the wax may be present in an amount of, for example, from about 1 weight percent to about 25 weight percent of the toner particles, in embodiments from about 5 weight percent to about 20 weight percent of the toner particles.

Waxes that may be selected include waxes having, for example, a weight average molecular weight of from about 200 to about 20,000, in embodiments from about 400 to about 5,000. Waxes that may be used include, for example, polyolefins such as polyethylene, polypropylene, and polybutene waxes such as commercially available from Allied Chemical and Petrolite Corporation, for example POLYWAX™ polyethylene waxes from Baker Petrolite, wax emulsions available from Michaelman, Inc. and the Daniels Products Company, EPOLENE N-15™ commercially available from Eastman Chemical Products, Inc., and VISCOL 550-P™, a low weight average molecular weight polypropylene available from Sanyo Kasei K.K.; plant-based waxes, such as carnauba wax, rice wax, candelilla wax, sumacs wax, and jojoba oil; animal-based waxes, such as beeswax; mineral-based waxes and petroleum-based waxes, such as montan wax, ozokerite, ceresin, paraffin wax, microcrystalline wax, and Fischer-Tropsch wax; ester waxes obtained from higher fatty acid and higher alcohol, such as stearyl stearate and behenyl behenate; ester waxes obtained from higher fatty acid and monovalent or multivalent lower alcohol, such as butyl stearate, propyl oleate, glyceride monostearate, glyceride distearate, and pentaerythritol tetra behenate; ester waxes obtained from higher fatty acid and multivalent alcohol multimers, such as diethyleneglycol monostearate, dipropyleneglycol distearate, diglyceryl distearate, and triglyceryl tetrastearate; sorbitan higher fatty acid ester waxes, such as sorbitan monostearate, and cholesterol higher fatty acid ester waxes, such as cholesteryl stearate. Examples of functionalized waxes that may be used include, for example, amines, amides, for example AQUA SUPERSLIP 6550™, SUPERSLIP 6530™ available from Micro Powder Inc., fluorinated waxes, for example POLYFLUO 190™, POLYFLUO 200™, POLYSILK 19™, POLYSILK 14™ available from Micro Powder Inc., mixed fluorinated, amide waxes, for example MICROSPERSION 19™ also available from Micro Powder Inc., imides, esters, quaternary amines, carboxylic acids or acrylic polymer emulsion, for example JONCRYL 74™, 89™, 130™, 537™, and 538™, all available from SC Johnson Wax, and chlorinated polypropylenes and polyethylenes available from Allied Chemical and Petrolite Corporation and SC Johnson wax. Mixtures and combinations of the foregoing waxes may also be used in embodiments. Waxes may be included as, for example, fuser roll release agents.

Toner Preparation

The toner particles may be prepared by any method within the purview of one skilled in the art. Although embodiments relating to toner particle production are described below with respect to melt mixing, any suitable method of preparing toner particles may be used, including chemical processes, such as suspension and encapsulation processes disclosed in U.S. Pat. Nos. 5,290,654 and 5,302,486, the disclosures of each of which are hereby incorporated by reference in their entirety. Emulsion aggregation methods may also be utilized, including the preparation of toner compositions and toner particles by aggregation and coalescence processes in which small-size resin particles are aggregated to the appropriate toner particle size and then coalesced to achieve the final toner particle shape and morphology.

In embodiments, toners of the present disclosure may be formed by melt mixing utilizing methods and apparatus within the purview of those skilled in the art. For example, melt mixing of the toner ingredients can be accomplished by physically mixing or blending the particles and then melt mixing, for example, in an extruder or a Banbury/two roll mill apparatus. Suitable temperatures may be applied to the extruder or similar apparatus, for example from about 65° C. to about 200° C., in embodiments from about 80° C. to about 120° C.

The components of the toner, including the amorphous resin, the crystalline resin, fatty acid salt, wax, if any, colorant, and other additives, may be combined so that the toner extrudate has the desired composition of colorants and additives. The toner extrudate may then, in embodiments, be divided into a pellet or rough crushed form, sometimes referred to herein as "pelletizing," utilizing methods within the purview of those skilled in the art, for example, by pelletizers, fitzmilling, pinmilling, grinders, classifiers, additive blenders, screeners, combinations thereof, and the like. As used herein, "pelletizing" may include any process within the purview of those skilled in the art which may be utilized to form the toner extrudate into pellets, a rough crushed form, or coarse particles, and "pellets" include toner extrudate divided into pellet form, rough crushed form, coarse particles, or any other similar form.

As noted above, the addition of a crystalline polyester to an amorphous polyester in forming the binder resin may result in a suppression of the glass transition temperature (Tg) of the toner, sometimes referred to herein, in embodiments, as plasticization. Plasticization may not be desirable because if the Tg is too low for a toner, there may be problems in storage, for example blocking, and usage of the toner at elevated temperatures. Thus, in embodiments, it may be desirable to treat the toner to increase its Tg by the addition of a fatty acid salt as described above.

The binder resin, including the amorphous and crystalline resins, as well as the fatty acid salts described above, may be present in the resulting toner in an amount from about 50 weight percent to about 99 weight percent of the toner composition, in embodiments from about 70 weight percent to about 97 weight percent of the toner composition, with the colorant being present in an amount from about 1 to about 50 weight percent of the toner composition, in embodiments from about 3 to about 20 weight percent of the toner composition.

The toner pellets may then be subjected to grinding utilizing, for example, an Alpine AFG fluid bed grinder, or Sturtevant micronizer, for the purpose of achieving toner particles with a volume median diameter of less than about 25 microns, in embodiments from about 5 microns to about 15 microns, in other embodiments from about 5.5 microns to about 12 microns, which diameters can be determined by a Multisizer II from Beckman Coulter. Subsequently, the toner compositions can be classified utilizing, for example, a Donaldson Model B classifier for the purpose of removing toner fines, that is, toner particles less than about 5 microns volume median diameter.

Other optional treatments to increase the Tg of the toner include, for example, annealing, slow cooling, combinations thereof, and the like. Such treatments may be utilized after formation of pellets, but prior to grinding.

For example, in embodiments the toner may be subjected to an annealing step. An example is described in U.S. Patent Application Publication No. 2009/0081577, the disclosure of which is hereby incorporated by reference in its entirety.

This annealing step may occur by continuously processing the toner by introducing toner pellets produced after melt-mixing into a heating device, in embodiments a rotary kiln, fluidized bed dryer, combinations thereof, and the like, where the toner is heated to a temperature above its Tg. Suitable devices for annealing the toners may be readily constructed or obtained from commercial sources including, for example, rotary kilns from Harper Corporation. In embodiments, a rotary kiln from Harper Corporation which may be utilized may have a diameter of about 5 inches, a length of about 6 feet, and can operate at from about 1 revolutions per minute (rpm) to about 15 rpm, with a maximum kiln angle of about 30 degrees.

In embodiments, heating the toner to a temperature above its Tg, sometimes referred to herein, in embodiments, as annealing, may allow the polymer system of the binder resin to relax, thereby permitting the crystalline domains of the crystalline polyester component of the binder to recrystallize. This recrystallization will increase the Tg of the toner, thereby avoiding the storage and usage problems which may otherwise occur with a toner having a low Tg.

In embodiments, a suitable temperature for annealing may be from about 50° C. to about 90° C., in embodiments from about 60° C. to about 80° C. In embodiments, annealing the toner may occur for a period of time from about 2 minutes to about 60 minutes, in embodiments from about 15 minutes to about 45 minutes. After annealing, the toner may experience an increase in Tg due to decreased plasticization.

A suitable system for carrying out the annealing described herein may utilize the above systems and any other components within the purview of those skilled in the art. In embodiments, a suitable system for forming and annealing toner may include a melt-mixing device to form an extruded toner; a pelletizer, pinmill, fitzmill, or other device to form the extruded toner into pellets, rough crushed form, coarse particles, or the like; and an annealing device such as rotary kilns, fluidized bed dryers, and combinations thereof to form the desired toner particles.

Additives

In embodiments, the toner particles may also contain other optional additives, as desired or required. For example, the toner may include any known charge additives in amounts of from about 0.1 to about 10 weight percent, and in embodiments of from about 0.5 to about 7 weight percent of the toner. Examples of such charge additives include alkyl pyridinium halides, bisulfates, the charge control additives of U.S. Pat. Nos. 3,944,493, 4,007,293, 4,079,014, 4,394,430 and 4,560,635, the disclosures of each of which are hereby incorporated by reference in their entirety, negative charge enhancing additives like aluminum complexes, and the like.

In addition, there can be blended with the toner particles external additive particles including flow aid additives, which additives may be present on the surface of the toner particles. Examples of these additives include metal oxides such as titanium oxide, silicon oxide, tin oxide, mixtures thereof, and the like; colloidal and amorphous silicas, such as AEROSIL®, metal salts and metal salts of fatty acids inclusive of zinc stearate, aluminum oxides, cerium oxides, and mixtures thereof. Each of these external additives may be present in an amount of from about 0.1 percent by weight to about 5 percent by weight of the toner, in embodiments of from about 0.25 percent by weight to about 3 percent by weight of the toner. Suitable additives include those disclosed in U.S. Pat. Nos. 3,590,000, 3,800,588, 6,214,507, and 7,452,646 the disclosures of each of which are hereby incorporated by reference in their entirety.

The resulting particles can possess the following characteristics:

1) an average volume particle diameter of from about 5 microns to about 15 microns, in embodiments from about 5.5 microns to about 12 microns;
2) Number Average Geometric Size Distribution (GSDn) and/or Volume Average Geometric Size Distribution (GSDv) of from about 1.0 to about 1.7, in embodiments from about 1.1 to about 1.6;
3) a glass transition temperature of from about 30° C. to about 65° C., in embodiments from about 35° C. to about 51° C.

As would be apparent to one skilled in the art, the maximum value for the glass transition temperature may be dependent upon the amorphous resin. For example, if the amorphous resin has a glass transition temperature of 55° C., the maximum value the toner could achieve is 55° C. The addition of the fatty acid salt to the binder resin, as well as additional optional steps such as annealing, may thus reduce plasticization and allow the glass transition temperature of the plasticized toner to increase toward the glass transition temperature of the original amorphous resin.

The characteristics of the toner particles may be determined by any suitable technique and apparatus. Volume average particle diameter $D_{50v}$, GSDv, and GSDn may be measured by means of a measuring instrument such as a Beckman Coulter Multisizer 3, operated in accordance with the manufacturer's instructions. Representative sampling may occur as follows: a small amount of toner sample, about 1 gram, may be obtained and filtered through a 25 micrometer screen, then put in isotonic solution to obtain a concentration of about 10%, with the sample then run in a Beckman Coulter Multisizer 3.

Developers

The toner particles thus obtained may be formulated into a developer composition. The toner particles may be mixed with carrier particles to achieve a two-component developer composition. The toner concentration in the developer may be from about 1% to about 25% by weight of the total weight of the developer, in embodiments from about 2% to about 15% by weight of the total weight of the developer.

Carriers

Examples of carrier particles that can be utilized for mixing with the toner include those particles that are capable of triboelectrically obtaining a charge of opposite polarity to that of the toner particles. Illustrative examples of suitable carrier particles include granular zircon, granular silicon, glass, steel, nickel, ferrites, iron ferrites, silicon dioxide, and the like. Other carriers include those disclosed in U.S. Pat. Nos. 3,847,604, 4,937,166, and 4,935,326.

The selected carrier particles can be used with or without a coating. In embodiments, the carrier particles may include a core with a coating thereover which may be formed from a mixture of polymers that are not in close proximity thereto in the triboelectric series. The coating may include fluoropolymers, such as polyvinylidene fluoride resins, terpolymers of styrene, methyl methacrylate, and/or silanes, such as triethoxy silane, tetrafluoroethylenes, other known coatings and the like. For example, coatings containing polyvinylidenefluoride, available, for example, as KYNAR 301F™, and/or polymethylmethacrylate, for example having a weight average molecular weight of about 300,000 to about 350,000, such as commercially available from Soken, may be used. In embodiments, polyvinylidenefluoride and polymethylmethacrylate (PMMA) may be mixed in proportions of from about 30 to about 70 weight % to about 70 to about 30 weight %, in embodiments from about 40 to about 60 weight % to about 60 to about 40 weight %. The coating may have a coating weight of, for example, from about 0.1 to about 5% by weight of the carrier, in embodiments from about 0.5 to about 2% by weight of the carrier.

In embodiments, PMMA may optionally be copolymerized with any desired comonomer, so long as the resulting copolymer retains a suitable particle size. Suitable comonomers can include monoalkyl, or dialkyl amines, such as a dimethylaminoethyl methacrylate, diethylaminoethyl methacrylate, diisopropylaminoethyl methacrylate, or t-butylaminoethyl methacrylate, and the like. The carrier particles may be prepared by mixing the carrier core with polymer in an amount from about 0.05 to about 10 percent by weight, in embodiments from about 0.01 percent to about 3 percent by weight, based on the weight of the coated carrier particles, until adherence thereof to the carrier core by mechanical impaction and/or electrostatic attraction.

Various effective suitable means can be used to apply the polymer to the surface of the carrier core particles, for example, cascade roll mixing, tumbling, milling, shaking, electrostatic powder cloud spraying, fluidized bed, electrostatic disc processing, electrostatic curtain, combinations thereof, and the like. The mixture of carrier core particles and polymer may then be heated to enable the polymer to melt and fuse to the carrier core particles. The coated carrier particles may then be cooled and thereafter classified to a desired particle size.

In embodiments, suitable carriers may include a steel core, for example of from about 25 to about 100 μm in size, in embodiments from about 50 to about 75 μm in size, coated with about 0.5% to about 10% by weight, in embodiments from about 0.7% to about 5% by weight, of a conductive polymer mixture including, for example, methylacrylate and carbon black using the process described in U.S. Pat. Nos. 5,236,629 and 5,330,874.

The carrier particles can be mixed with the toner particles in various suitable combinations. The concentrations are may be from about 1% to about 20% by weight of the toner composition. However, different toner and carrier percentages may be used to achieve a developer composition with desired characteristics.

Imaging

The toners can be utilized for electrostatographic processes, including those disclosed in U.S. Pat. No. 4,295,990, the disclosure of which is hereby incorporated by reference in its entirety. In embodiments, any known type of image development system may be used in an image developing device, including, for example, magnetic brush development, jumping single-component development, hybrid scavengeless development (HSD), and the like. These and similar development systems are within the purview of those skilled in the art.

Imaging processes include, for example, preparing an image with an electrophotographic device including a charging component, an imaging component, a photoconductive component, a developing component, a transfer component, and a fusing component. In embodiments, the development component may include a developer prepared by mixing a carrier with a toner composition described herein. The electrophotographic device may include a high speed printer, a black and white high speed printer, a color printer, and the like.

Once the image is formed with toners/developers via a suitable image development method such as any one of the aforementioned methods, the image may then be transferred to an image receiving medium such as paper and the like. In embodiments, the toners may be used in developing an image in an image-developing device utilizing a fuser roll member. Fuser roll members are contact fusing devices that are within the purview of those skilled in the art, in which heat and pressure from the roll may be used to fuse the toner to the image-receiving medium. In embodiments, the fuser member may be heated to a temperature above the fusing temperature of the toner, for example to temperatures of from about 100° C. to about 200° C., in embodiments from about 110° C. to about 180° C., in other embodiments from about 120° C. to about 170° C., after or during melting onto the image receiving substrate.

In embodiments where the toner resin is crosslinkable, such crosslinking may be accomplished in any suitable manner. For example, the toner resin may be crosslinked during fusing of the toner to the substrate where the toner resin is crosslinkable at the fusing temperature. Crosslinking also may be affected by heating the fused image to a temperature at which the toner resin will be crosslinked, for example in a post-fusing operation. In embodiments, crosslinking may be effected at temperatures of from about 200° C. or less, in embodiments from about 100° C. to about 190° C., in other embodiments from about 120° C. to about 180° C.

The following Examples are being submitted to illustrate embodiments of the present disclosure. These Examples are intended to be illustrative only and are not intended to limit the scope of the present disclosure. Also, parts and percentages are by weight unless otherwise indicated. As used herein, "room temperature" refers to a temperature of from about 20° C. to about 25° C.

EXAMPLES

Example 1

A resin system of the present disclosure was produced as follows. A toner containing 20% CPES A3C crystalline polyester (a proprietary blend of 1,4-butanediol, fumaric acid, and adipic acid available from Kao Corporation (Japan), having monomer units of less than 8 carbons), was combined with a partially crosslinked propoxylated bisphenol-A fumarate amorphous polyester prepared as described in U.S. Pat. No. 6,359,105, the disclosure of which is hereby incorporated by reference in its entirety, and a fatty acid salt (zinc stearate-laurate (ZnSt-L), or calcium stearate (CaSt)). The amounts of the amorphous polyester and fatty acid salt were varied: details are provided in Table 1 below. A control resin system was produced which had no fatty acid salt.

The materials were compounded on an APV extruder and the Tg was measured on a Q1000 TA modulated differential scanning calorimetry (DSC), utilizing the following scheme: Approximately 10 mg of each sample was weighed into an aluminum pan and analyzed using the Q1000 TA Instrument, operating at the following temperature program:

Equilibrate at 0.00° C.
Modulate +/−0.48° C. every 60 seconds
Isothermal for 5 minutes
Ramp 3° C./minute to 160° C.

TABLE 1

The effect of fatty acid salt to reduce plasticization.

| Control | | | |
|---|---|---|---|
| % A3C (Crystalline) | % ZnSt-L | % Amorphous | Onset Tg (° C.) |
| 20 | 0 | 80 | 21.7 |
| **ZnSt-L** | | | |
| % A3C (Crystalline) | % ZnSt-L | % Amorphous | Onset Tg (° C.) |
| 20 | 5 | 75 | 39.9 |
| 20 | 10 | 70 | 37.8 |
| **CaSt** | | | |
| % A3C (Crystalline) | % CaSt | % Amorphous | Onset Tg (° C.) |
| 20 | 5 | 75 | 37.2 |
| 20 | 10 | 70 | 40.6 |

As can be seen from Table 1, the control toner having no fatty acid salt was highly plasticized with a Tg of 21.7° C. To the contrary, toners of the present disclosure possessing zinc stearate-laurate or calcium stearate had almost double the Tg, with both the addition of 5% or 10% salt. As described above, the higher the Tg, the lower the amount of plasticization.

It will be appreciated that various of the above-disclosed and other features and functions, or alternatives thereof, may be desirably combined into many other different systems or applications. Also that various presently unforeseen or unanticipated alternatives, modifications, variations or improvements therein may be subsequently made by those skilled in the art which are also intended to be encompassed by the following claims. Unless specifically recited in a claim, steps or components of claims should not be implied or imported from the specification or any other claims as to any particular order, number, position, size, shape, angle, color, or material.

What is claimed is:

1. A toner composition comprising:

a binder resin comprising at least one amorphous resin, at least one crystalline resin, and a fatty acid salt; and one or more optional ingredients selected from the group consisting of colorants, waxes, and combinations thereof, wherein the fatty acid salt is present in an amount of from about 5 percent to about 10 percent by weight of the toner composition.

2. The toner composition of claim 1, wherein the binder resin is present in an amount from about 50 weight percent to about 99 weight percent of the toner composition.

3. The toner composition of claim 1, wherein the colorants comprise a pigment, dye, or combinations thereof.

4. The toner composition of claim 1, wherein the at least one amorphous resin is selected from the group consisting of polyester resins, partially crosslinked polyester resins, and combinations thereof.

5. The toner composition of claim 1, wherein the at least one crystalline resin comprises a monomer system comprising an alcohol selected from the group consisting of 1,4-butanediol, 1,6-hexanediol, and combinations thereof.

6. The toner composition of claim 1, wherein the crystalline resin comprises monomer units of about 8 carbon atoms or less.

7. The toner composition of claim 1, wherein the fatty acid salt is selected from the group consisting of zinc stearate, zinc laurate, zinc stearate-laurate, calcium stearate, zinc palmitate, magnesium stearate, and combinations thereof.

8. The toner composition of claim 1, wherein the toner composition exhibits a glass transition temperature of from about 35° C. to about 51° C.

9. The toner composition of claim 1, wherein the toner composition exhibits a glass transition temperature of from about 30° C. to about 65° C.

10. The toner composition of claim 9, wherein the colorants are present in an amount from about 1 to about 50 weight percent of the toner composition.

11. The toner composition of claim 9, wherein the at least one crystalline resin comprises a polyester.

12. The toner composition of claim 9, wherein the at least one crystalline resin comprises a monomer system comprising a dicarboxylic acid selected from the group consisting of fumaric acid, succinic acid, oxalic acid, adipic acid and combinations thereof.

13. The toner composition of claim 1, wherein the toner composition exhibits lower plasticization as compared to a toner composition having no fatty acid salt.

* * * * *